United States Patent [19]

Hwa

[11] 4,042,415

[45] Aug. 16, 1977

[54] METHOD FOR SCRAPING LIQUIDS FROM A MOVING SURFACE

[75] Inventor: Stephen C. P. Hwa, Penfield, N.Y.

[73] Assignee: Xerox Corporation, Stamford, Conn.

[21] Appl. No.: 598,446

[22] Filed: July 23, 1975

Related U.S. Application Data

[62] Division of Ser. No. 473,535, May 28, 1974, Pat. No. 3,918,807.

[51] Int. Cl.[2] ..... B08B 1/02

[52] U.S. Cl. ..... 134/6; 355/15

[58] Field of Search ..... 134/6; 15/256.5, 256.51; 355/15, 10, 3 R

[56] References Cited

U.S. PATENT DOCUMENTS

| | | | |
|---|---|---|---|
| 2,418,706 | 4/1947 | Goyette | 15/256.51 |
| 3,125,142 | 3/1964 | Andersson | 15/256.5 X |
| 3,183,541 | 5/1965 | Goyette | 15/256.5 X |
| 3,788,219 | 1/1974 | Gallagher | 15/256.51 X |
| 3,811,914 | 5/1974 | Saito et al. | 355/10 X |
| 3,859,691 | 1/1975 | Katayama et al. | 15/256.51 |
| 3,871,762 | 3/1975 | Vlasakker | 355/15 |
| 3,940,282 | 2/1976 | Hwa | 355/15 X |

*Primary Examiner*—S. Leon Bashore
*Assistant Examiner*—Marc L. Caroff
*Attorney, Agent, or Firm*—James J. Ralabate; Ernest F. Chapman

[57] ABSTRACT

Surfaces are cleaned of liquid developer by a blade having a configuration which deflects material away from the surface undergoing cleaning while it cleans the surface as a scraper blade. The blade provides a scraper function in addition to conveying the liquid developer cleaned from the surface to a retention reservoir.

1 Claim, 2 Drawing Figures

METHOD FOR SCRAPING LIQUIDS FROM A MOVING SURFACE

This is a division of application Ser. No. 473,535, filed May 28, 1974, now U.S. Pat. No. 3,918,807.

BACKGROUND OF THE INVENTION

This invention relates to cleaning material from a support surface, and more particularly, it relates to an apparatus and method for removing liquid developer from a photoconductive or other surface.

In the development of electrostatic latent images where liquid developers are used to develop the image on the reusable photoconductor surface or on a reusable interposition surface, liquid developer remains on the surface after the developer image is transferred to a substrate. In these processes and apparatuses where the surface is reused to develop subsequent images, the residual liquid developer must be removed therefrom to such an extent that the residual developer will not interfere with subsequent imaging causing image or non-image patterns and smudges of developer which transfer to subsequent substrates. Cleaning blades are commonly used to remove the residual liquid developers from these and other support surfaces.

U.S. Pat. No. 3,660,863 issued to Gerbasi on May 9, 1972, discloses a scraper blade acting on a xerographic drum for removing particulate toner material from the drum. In Gerbasi, the cutting edge of the blade, that is, the edge of the blade formed by the upper face surface or top surface and the front side surface, is positioned slightly below the horizontal center line of the drum and the cutting edge held in a manner to readily cut or chisel the particulate toner material from the drum surface. This configuration works fine for particulate toner material, however, when used with liquid developers this configuration causes fluids to permeate machine parts when they drip from the support surface in various spots. Blade cleaning is also described by Royka et al. in U.S. Pat. No. 3,552,850 wherein at least one self-adjusting flexible cleaning blade for pressure contact cleaning of the imaging surface is shown. In Royka et al, the leading edge of at least one cleaning blade is preferably positioned to form an acute angle of less than about 90° and greater than about 20° with the confronting portion of the imaging surface or plane tangent to the imaging surface at the line of blade contact to clean particulate toner from photoconductive members when means to supply a dry solid lubricant to the imaging surface are provided. As discussed above, this cleaning technique is operable for particulate toner, but when liquid developers are used, the fluids collect on the photoconductive members and fall into machine parts in various locations of the copier. Furthermore, the wiping action does not suitably remove the liquid developers from the surface.

In accordance with the present invention cleaning blades may be designated as scraper blades or wiper blades. A scraper blade is defined as one wherein the stem extends towards the top in the upstream direction of the drum's movement and when pressed against the drum exerts a chiselling action on the material on the drum surface. When such a blade is used for cleaning liquid material from a support surface which in operation moves uphill, problems are encountered in disposing of the liquid cleaned or removed from the surface. It may run back over the uncleaned part of the surface and drip off at random positions.

A blade which in operation is pressed against a support surface so that it is bent along its length in the downstream direction of the drum motion has a wiping action as it tends to be lifted up by material moving with the drum surface, but will wipe any material moving in the opposite direction away from the drum surface. A wiper blade is defined in accordance with the present invention as one in which the stem extends in the downstream direction of the drum motion. As used herein, upstream and downstream refer to drum motion.

OBJECTS OF THE INVENTION

It is an object of this invention to provide an apparatus and method for improving the cleaning of reusable surfaces used in electrostatic copying machines employing liquid developers for development of the image.

Another object of this invention is to provide an apparatus and method to improve the removal of liquid developer from reusable surfaces when scraper blades are used as the cleaning blades.

Another object of this invention is to provide an apparatus and method to prevent the liquid developer cleaned from a reusable surface in an electrostatic copying machine, from running back over the uncleaned part of the surface causing it to drip off at random positions.

SUMMARY OF THE INVENTION

These and other objects are accomplished by providing a cleaning apparatus for cleaning material from a support surface adapted to move in a given direction, a cleaning blade with a tip and first or upper stem portion adapted to be mounted as a scraper blade as herein defined in contact with the support surface, and with a lower stem portion extending towards the tip portion with a component in said given direction.

When such a blade is used in conjunction with another scraper blade downstream in said given direction, the lower stem portion acts to deflect material (liquid developer) moving in opposition to said given direction away from the surface, while the tip and upper stem portion acts as a separate scraper blade.

According to the present invention, there is provided a method of simultaneously removing and deflecting liquid developer from a moving support surface, for example, a photoconductive surface in an electrostatic copying machine, by providing a scraper blade in contact with the support surface and having a lower stem portion extending towards the tip portion with a component in said given direction. In essence, the method of deflecting liquid developer from a surface capable of moving in a given direction and capable of carrying an electrostatic latent image comprises engaging at least one scraper blade with the surface capable of carrying an electrostatic latent image, said scraper blade having an upper stem portion extending opposite said given direction to a point of contact of the upper stem portion with said surface, said point of contact on the upper stem portion being a cutting tip, and a lower stem portion extending towards the upper stem portion in said given direction until it intersects and forms an angle with the upper stem portion, the upper stem portion having a drip tip adjacent the point of contact of the upper stem portion with said surface and moving the surface capable of carrying an electrostatic latent image in a given direction, whereby the cutting tip removes liquid developer from said surface and deflects the removed liquid developer from said surface at the drip tip.

Additional objects of this invention will become apparent to those versed in the art of electrostatic copying machines in view of the following detailed description of the method and apparatus taken in conjunction with the accompanying drawings in which preferred embodiments of the apparatus are shown.

DESCRIPTION OF THE PREFERRED EMBODIMENTS

Figure 1:
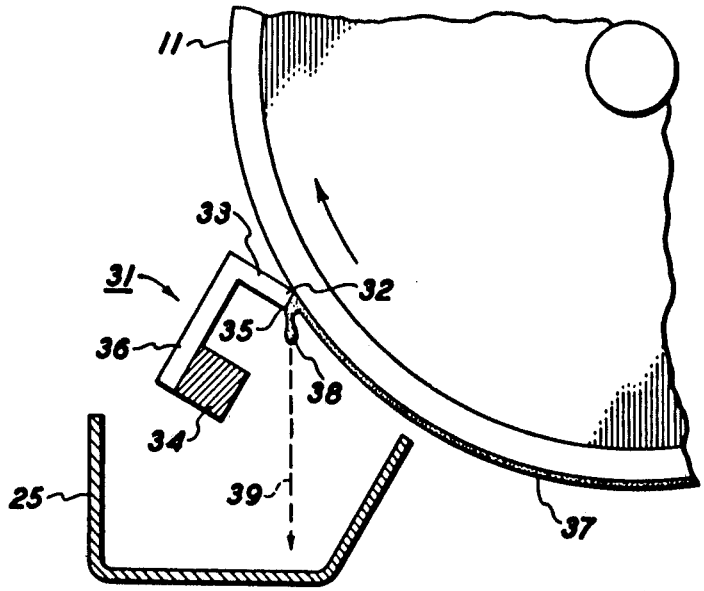
FIG. 1 shows a sectional view of a scraper blade of the present invention.

The cleaning station mode shown in FIG. 1 illustrates the novel scraper blade of the present invention and the manner in which the blade operates. The blade is L-shaped and may be described as having a tip portion or upper stem portion 33 which is the base of the L. The upper stem or tip portion 33 is adapted to contact the support surface of drum 11 at tip 32 as a scraper blade as defined supra, said drum being adapted to move in a given direction. The upper stem or tip portion 33 of blade 31 extends towards drum 11 and has a component culminating in tip 32 directed upstream (counter to the direction of the drum movement). The blade acts as a scraper, the tip 32 of the blade preferably being a 90° angle or any other suitable angle so as to form a cutting or chiselling edge at tip 32.

The tip portion or upper stem portion 33 of blade 31 is preferably of rectangular longitudinal cross-section and also comprises a drip tip 35 which is adjacent cutting tip 32 extending outward from the point at which the cutting tip contacts the support surface and preferably in an upstream direction. In the most preferred embodiment cutting tip 32 and drip tip 35 are tips or points formed from right angle intersections of the blade material. Drip tip or point 35 must be located in such a manner that liquid developer on the drum surface and scraped from said surface by cutting tip 32 will be conveyed to drip tip 35 where it will be deflected away from the surface of drum 11.

Cleaning blade 31 as illustrated in FIG. 1 also comprises a lower stem portion 36 connected to the upper stem portion 33 preferably at a 90° angle therewith. The lower stem portion 36 is the upstanding portion of the L (beyond the angle of the L) and extends towards drum 11, this component being directed downstream (in the direction of the drum motion). The upper stem portion and lower stem portion of blade 31 are preferably the same material. Scraper blade 31 is mounted on mounting block 34 and supports blade 31 by engaging lower stem 36. Mounting block 34 may be movably mounted to permit withdrawal of cleaning blade 31 from the surface of drum 11 when the apparatus is out of operation. Blade portion 36 (lower stem portion) may be detachably mounted to mounting block 34 to permit replacement of the blade.

As illustrated in FIG. 1, as drum 11 moves in the direction of the arrow is an uphill direction, scraper blade 31 engaging the surface of drum 11 at cutting tip 32, scrapes the residual liquid developer 37 (including solids such as lint and dust entrained therein) from the surface of drum 11 upstream from the cutting tip, the liquid developer accumulates on the blade edge and departs or deflects therefrom at drip tip 35. The liquid developer is shown dripping from tip 35 in the form of drops (numeral 38) and falling in the direction of dotted line 39 to sump or reservoir 25. This novel method of deflecting the liquid developer from the surface of a photoconductive drum prevents the liquid developer scraped from the photoconductive surface, from accumulating in quantities at the scraping edge or tip of the blade and running upstream where it tends to drip from the surface at various locations into machine parts or into an extensive reservoir system, while at the same time efficient cleaning is accomplished by the scraping action of the blade on the surface of drum 11 to provide a surface downstream from the scraper blade 31 suitably cleaned of liquid developer.

Figure 2:
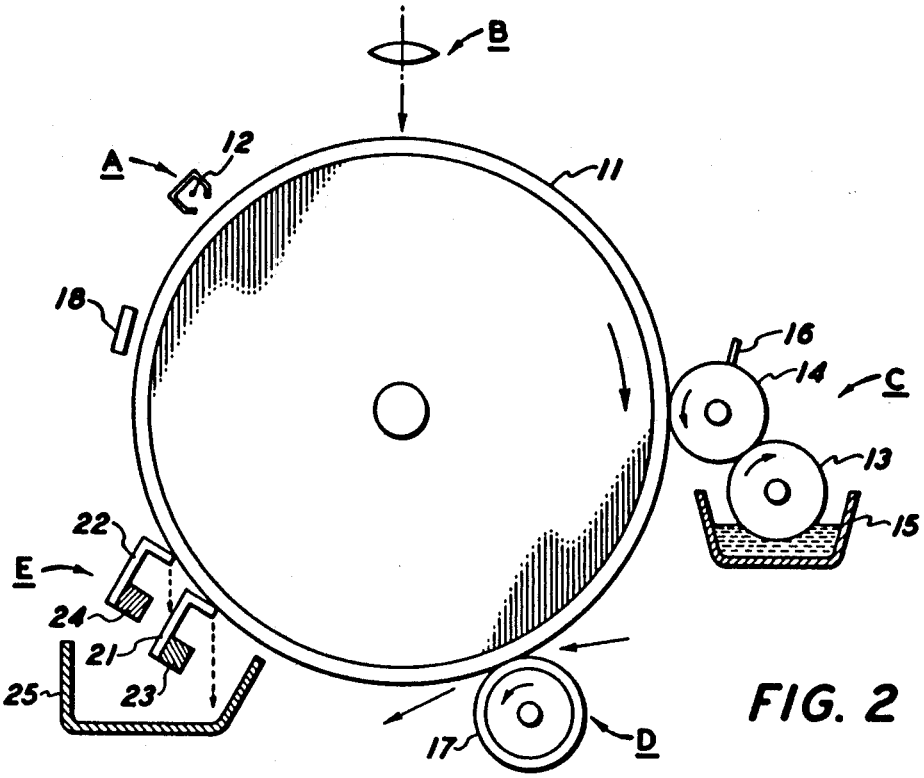
FIG. 2 shows a schematic sectional view of an electrostatographic copying apparatus wherein the cleaning station comprises two scraper blades of the present invention.

In the copying apparatus illustrated in FIG. 2, a copying drum 11 having a photoconductive surface is rotated in the direction of the arrow about its axis so that the surface passes through a number of processing stations. The copying cycle starts at the charging station A wherein a corona discharge device 12 is energized to a high potential to apply charge to the drum surface. The drum then passes to the exposure station B where an image is projected on the charged drum surface by an optical system (not shown) to produce an electrostatic latent image. The image flows so that it moves in synchronism with the moving drum surface. The latent image passes to the development station C at which liquid developer is applied from a reservoir 15 by means of rolls 13 and 14. The roll 13 is a supply roll whose lower portion dips into the liquid in the reservoir 15 and whose upper portion is spaced by (for example) 0.25 mm from the upper roll 14 which has its surface shaped with a helical groove. The roll 14 is provided with a flexible doctor blade 16 which removes liquid from roll 14 to below the groove upper edges due to the deformation of the blade into the groove. The developer is attracted by electrostatic attraction from the remote part of the groove to the latent image across the gap between them to develop the image. An example of this method of development is described in detail in U.S. Pat. No. 3,084,043 issued to Robert W. Gundlach, which is incorporated herein by reference, wherein there is claimed a method of development in xerography comprising positioning close but spaced from an electrostatic latent image on an image bearing surface a substantially continuous film of electrically conductive ink comprising a homogeneous liquid solution, providing flow aiding elements in physical contact between said ink and said image bearing surface, and applying a bias to said ink whereby ink moves along said flow aiding elements and develops said electrostatic latent image.

A sheet of paper is fed to a transfer station D by sheet feed apparatus (not shown) to move in synchronism with the drum and is pressed against the drum surface by a transfer roll 17 so that the developed image is transferred to the paper which is then conveyed away from the transfer station through a chute (not shown). Any material remaining on the drum after the transfer station must now be cleaned off at the cleaning station E. After cleaning, electroluminescent strip 18 floods the drum surface with light to discharge any remaining charges, so that the drum can pass onto the charging station for the beginning of the next cycle. A drive mechanism to move the support surface past the various stations in succession and to move various other rolls is not shown. Means to move these various surfaces can be readily provided by one skilled in the art.

At the cleaning station in FIG. 2, there are provided two scraper blades 21 and 22 as described above and in FIG. 1. The scraper blades are mounted on supporting blocks 23 and 24 respectively, which can be moved away from drum 11 to withdraw the blades from the drum when they are not in use. If the blades are left pressing hard against a stationary drum, the photoconductive surface may be deformed and the blades may acquire a permanent set. A sump 25 is located below the scraper blades to catch the liquid from the blades.

Each scraper blade is preferably of polyurethane of 65 Shore A hardness, however, scraper blades having a hardness of about 90 Shore A or higher are also within the scope of the invention. The upper stem portion of the scraper blades are preferably about three-fourths inch long and 80 thousandths of an inch thick. The blades are clamped on supporting blocks 23 and 24 over about the first third of its length by any suitable means. The cutting tip of the upper stem portion of the blades are preferably at a 90° angle with the length of the upper stem portion of the blade so as to form a cutting edge from surfaces at 90°. A much smaller angle (such as 60°) at the cutting edge lends to failure by the edge becoming tucked under the upper stem portion of the blade by friction. The lower stem portion of the blade preferably extends at about 25° ± 5° to the tangent to the drum at the point of contact (a wider variation of angle being possible to suit different combinations of blades, liquids and drum surfaces), the blade preferably being slightly flexed against the drum in operation by the supporting blocks 23 and 24 with a force preferably of the order of 10 grams per centimeter. In accordance with the present invention, it is preferred that the upper stem portion have a rectangular longitudinal cross-section.

The developer liquid remaining on the drum after the transfer station D, together with any foreign matter, such as paper fibers, reaches scraper blade 21 first. In the mode shown in FIG. 2, the scraper blades 21 and 22 then scrape the material from drum 11 forming a bead at the end surface of each blade as shown in detail in FIG. 1. When this bead reaches a certain size, it will fall into the sump 25 from the drip tip of the first scraper blade or it will fall from the drip tip of the second (downstream) scraper blade to the back of the first scraper blade which then deflects the flowing material into the sump 25. Any liquid developer falling from the drip tip of the second or subsequent scraper blade 22, falls behind the upper stem portion or upon the lower stem portion of blade 21 and is eventually guided to sump 25 by the lower stem portion of blade 21. The same deflection of liquid developer occurs in those embodiments (not shown) wherein the second or downstream scraper blade 22 is a conventional non-angular or flexed scraper blade having no drip tip in which case the liquid developer collected thereby runs down the surface of drum 11 and collects behind the upper stem portion of blade 21 until it overflows and passes down the lower stem portion of blade 21 where it is directed to sump 25.

At least two scraper blades are preferred because the material reaching the first scraper blade contains paper fibers which are considered the main cause of blade failure. As paper fibers accumulate at the blade, the blade ceases to remove all the material from the drum surface. The provision of two scraper blades, as in FIG. 2, reduces the failure rate of the cleaning station, since the second scraper blade is likely to remove what the first scraper blade may miss. The paper fibers have been found to be retained by the first scraper blade, even if they may cause that blade to let some liquid past at the points where the fibers are engaged, so that few paper fibers reach the second blade to cause that blade to fail.

In accordance with the present invention as set forth in FIG. 1 where the cleaning blade is L-shaped, having a tip portion adapted to be mounted as a scraper blade in contact with the photoconductive (support) surface, and a stem portion extending towards the tip portion, a single scraper blade 31 may be used or multiple scraper blades 31 may be used. Alternatively, as explained supra, one or more scraper blades 31 may be used in conjunction with one or more conventional scraper blades.

In accordance with the stated objects, the present invention provides a suitable apparatus and method for cleaning liquid developer from a surface capable of carrying electrostatic latent images. While this invention has been described with reference to the structures and method steps disclosed herein, it is not confined to the details set forth; and this application is intended to cover such modifications or changes as may come within the purposes of the improvements or the scope of the following claims.

What is claimed is:

1. A method of deflecting liquid developer from a support surface movable in a given direction comprising engaging at least two scraper blades in succession in contact with the uphill portion of the support surface, so that a second scraper blade is downstream from a first scraper blade, at least the first scraper blade having an upper stem portion extending opposite said given direction to a point of contact of the upper stem portion with said surface, said point of contact on the upper stem portion being a cutting tip, and a lower stem portion extending towards the upper stem portion in said given direction until it intersects and forms an angle with the upper stem portion, the upper portion having a drip tip adjacent the point of contact of the upper stem portion with said surface; and moving the support surface in a given direction, whereby both blades scrape liquid developer from the support surface, and liquid developer accumulated by said second scraper blade collects at the downstream side of said first scraper blade and is removed by flowing over the lower stem portion of said first scraper blade.

* * * * *